US005441451A

United States Patent [19]

Jeung

[11] Patent Number: 5,441,451

[45] Date of Patent: Aug. 15, 1995

[54] AIR VENT CONTROL APPARATUS

[75] Inventor: Choon N. Jeung, Suwon, Rep. of Korea

[73] Assignee: Samsung Electronics Co., Ltd., Suwon, Rep. of Korea

[21] Appl. No.: 274,715

[22] Filed: Jul. 18, 1994

[30] Foreign Application Priority Data

Jul. 20, 1993 [KR] Rep. of Korea ..... 1993-13450 U

[51] Int. Cl.[6] ..... F24F 13/10

[52] U.S. Cl. ..... 454/313; 454/321

[58] Field of Search ..... 454/153, 202, 285, 313, 454/315, 321

[56] References Cited

U.S. PATENT DOCUMENTS 3,685,427 8/1972 Loyd ..... 454/202

4,653,386 3/1987 Hayakawa et al. ..... 454/313

4,777,870 10/1988 Bolton et al. ..... 454/313

*Primary Examiner*—Harold Joyce

*Attorney, Agent, or Firm*—Burns, Doane, Swecker & Mathis

[57] ABSTRACT

An air vent includes a louver blade mounted in a housing for rotation about an axis. A motor output shaft is connected to a driving link to rotate the driving link about the axis. A driven link in the form of a crank arm extends from the driving link to the louver blade. A spring in the form of a torsional coil spring interconnects the driving link and the driven link for transmitting rotation therebetween to adjust the louver blade. When an undesired external force is applied to the louver blade, the spring can yield elastically to prevent relative movement between the driving link and driven link in order to protect the motor.

13 Claims, 8 Drawing Sheets

AIR VENT CONTROL APPARATUS

BACKGROUND OF THE INVENTION

This invention relates to an air vent control apparatus, more particularly to an air vent control apparatus which interrupts an unwanted external force applied to a louver blade and which prevents the force from being transmitted to the motor.

A conventional air vent control apparatus is shown in FIGS. 4 and 5. The control unit ( not shown ) transmits to a stepping motor 7 a signal which is determined according to indoor temperature so that the air direction is controlled. The stepping motor 7 rotates a driving crank arm 8 upward or downward. The rotative force is transmitted to a link 10 connected with the driving crank arm 8 so that the link 10 moves upward or downward. Accordingly, first and second driven crank arms 5 and 6 connected to the upper and middle part of the link 10, respectively, are rotated by the rectilinear movement of the link 10, and finally first and second blades 2 and 3 are rotated to a certain angle in order to control the direction of the air flow.

However, if any rotative force external to the air control system is applied to at least one blade 2 and/or 3, the stepping motor 7 becomes unable to rotate the driving crank arm 8 in accordance with the signal transmitted from the control unit because the unwanted external force is transmitted to the driving shaft 7A of the stepping motor 7. As a result, the air direction determined by the first and second blades 2 and 3 is changed, even after the external force is removed. In addition, if the external force is applied frequently, the life time of the stepping motor 7 will be shortened, and also the stepping motor 7 may become damaged or ineffective.

The Korean Patent Application No. 92-100087 (1992, Jun. 10), names the same inventor as the present invention, disclosed one solution for the above problems as shown in FIGS. 6 to 8. As a motor 27 operates, a crank arm 27A having a free end situated in a slide perforation 30C of a link 30 is rotated. A first slide member 31 and a second slide member 32 are provided above and below the free end of the crank arm 27A, respectively. The first and second slide members 31 and 32 are interconnected by a resilient member 34. Protrusions 30E are affixed to the link 30. When the free arm is rotated, its free end moves in a circular pattern. For example, when that free end moves downwardly, it pushes the second slide 32 downwardly, and the second slide 32 pulls the first slide 31 downwardly, due to their interconnection by the spring 34. The first slide engages the protrusions 30E to displace the link 30 downwardly. Since the free end of the crank arm 27A moves in a circular pattern, it causes the link 30 to oscillate about a pivot connection between the link and a louver crank arm 26. Thus, the link 30 undergoes a compound movement in that it moves vertically (upwardly or downwardly) and simultaneously oscillates about an axis at its lower end. Only the vertical movement results in an adjustment of the louvers. Another louver crank arm 25 disposed above the crank arm 26 has its free end mounted in a slot of the link 30 to accommodate oscillation of the link 30. The vertical motion of the link 30 produces a rotational movement of crank arms 25 and 26 which are connected to louvers 22 and 23, respectively, so that the louvers blades 22 and 23 move within the predetermined range. When an incidental force is applied to the louver(s) 22 or 23, the crank arms 25 or 26 are rotated and the link 30 is moved in the direction of arrow "A". Protrusions 30E, push the second slide member 32 in the direction of the arrow "A". Hence, the first slide member 31 bearing against the upper portion of the crank arm 27A remains stationary position and the resilient member 34 is extended. Therefore, the external force applied to the louver 22 or 23 is not transmitted to the crank arm 27A, thereby preventing the movement of the motor 27 from being interrupted. Further, when the external force is no longer applied, the link 30 is moved upward by the restoring force of the resilient member 34. The louver 22 and 23 return to the intended position.

Because the above air vent control apparatus is operated through a arrangement of components, the whole structure is complicated, and consumes excessive space. Also, since an excessive number of parts are used, the efficiency is lowered and the production costs are increased.

SUMMARY OF THE INVENTION

An object of the present invention is to provide an air vent control apparatus whose structure is simple and occupies less space and has a greater efficiency and lower production costs.

Another object of the present invention is to provide an air vent control apparatus in which, when an external force is applied to a louver blade, the force is not transmitted to the motor, thereby preventing the motor from being damaged.

Another object of the present invention is to provide an air vent control apparatus in which, when the external force is removed, the affected blade will return to the intended position.

According to the present invention, the air vent control apparatus comprises a power generating means which generates the rotating force and an interrupting means in which the power of the power generating means can be transmitted to an air vent control member, or the power can be prevented from being transmitted to a blade when an external incidental force is against the intended moving direction of the blade applied to the blade. Further, the interrupting means comprises a driven link member which rotates in the direction of the rotation of the air vent control member when the force is applied, and an elastic member for applying the elastic force to the driven link member, whereby the movement of one free end of the elastic member is interrupted by a stopper and the other free end of the elastic member is moved along the driven link member when the external force is applied.

Further, the direction of movement of the one end and the other end of the elastic member which is formed in a torsional coil spring is reversed, respectively, when the direction of the external force is reversed.

The elastic force of the elastic member is greater than the rotation resistance force of the driven link member and is less than the rotation force of the power generating means.

When the motor is operated, the driven link member, which is interconnected to the louver blade, is rotated by the movement of the elastic member. Thus, the louver blade moves within the intended limit of rotation. When the driven link member is subjected to an unintended external force opposite to the swinging direction of the louver blade, the driven link member can be rotated simultaneously in the direction of the external force and it pushes the one free end of the torsional coil spring with the other free end of the elastic member contacting to the stopper so as to absorb the unintended external force. Thus, the force is not transmitted to the power generating means. When the force is removed from the louver blade, the driven link member is moved toward the supporter by the elastic energy of the elastic member. Therefore, the louver blade, is returned to the prescribed angular relationship to the motor.

DESCRIPTION OF THE PREFERRED EMBODIMENTS

Figure 1:
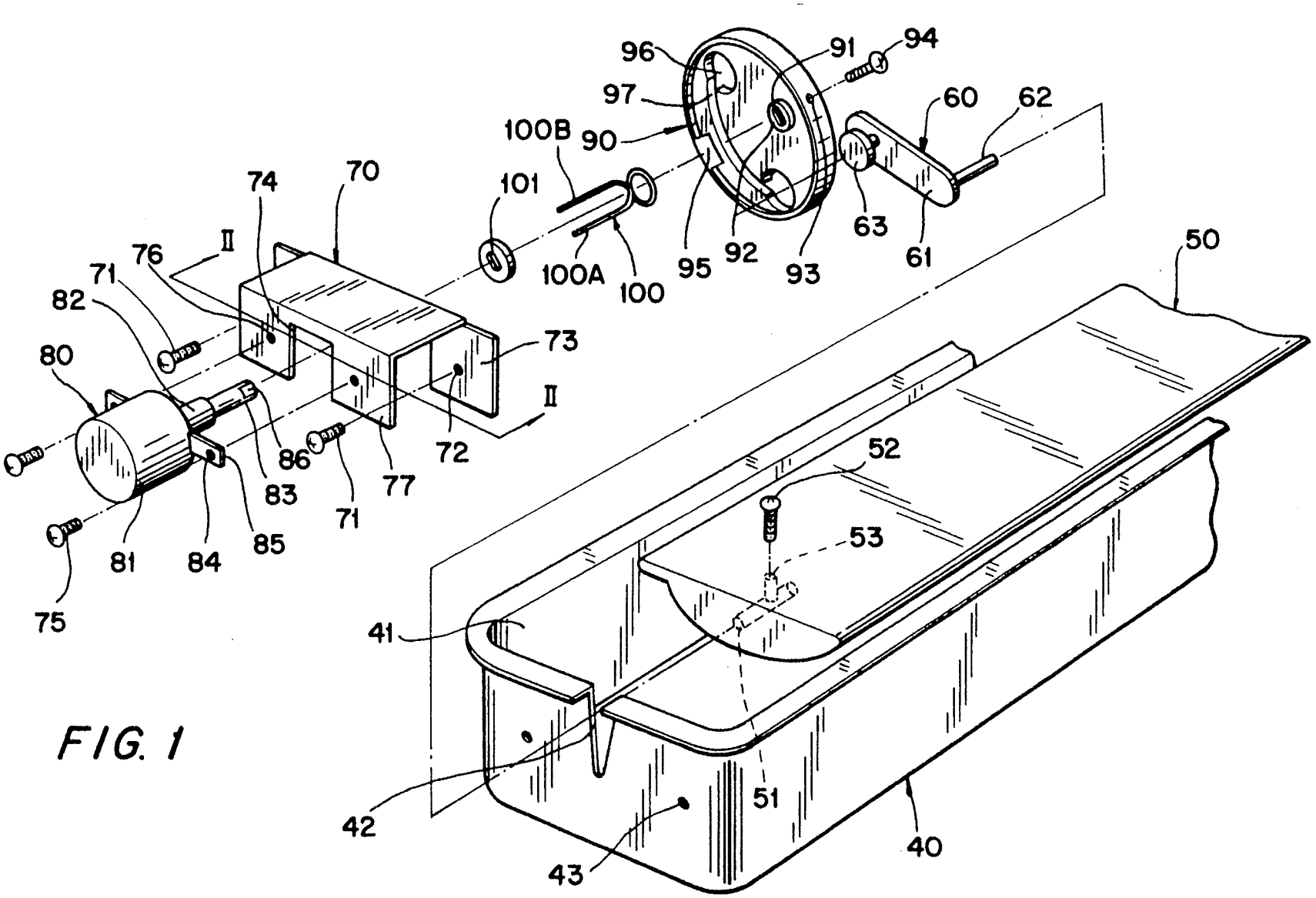
FIG. 1 is a perspective exploded view of an air vent control apparatus according to the present invention.
Figure 2:
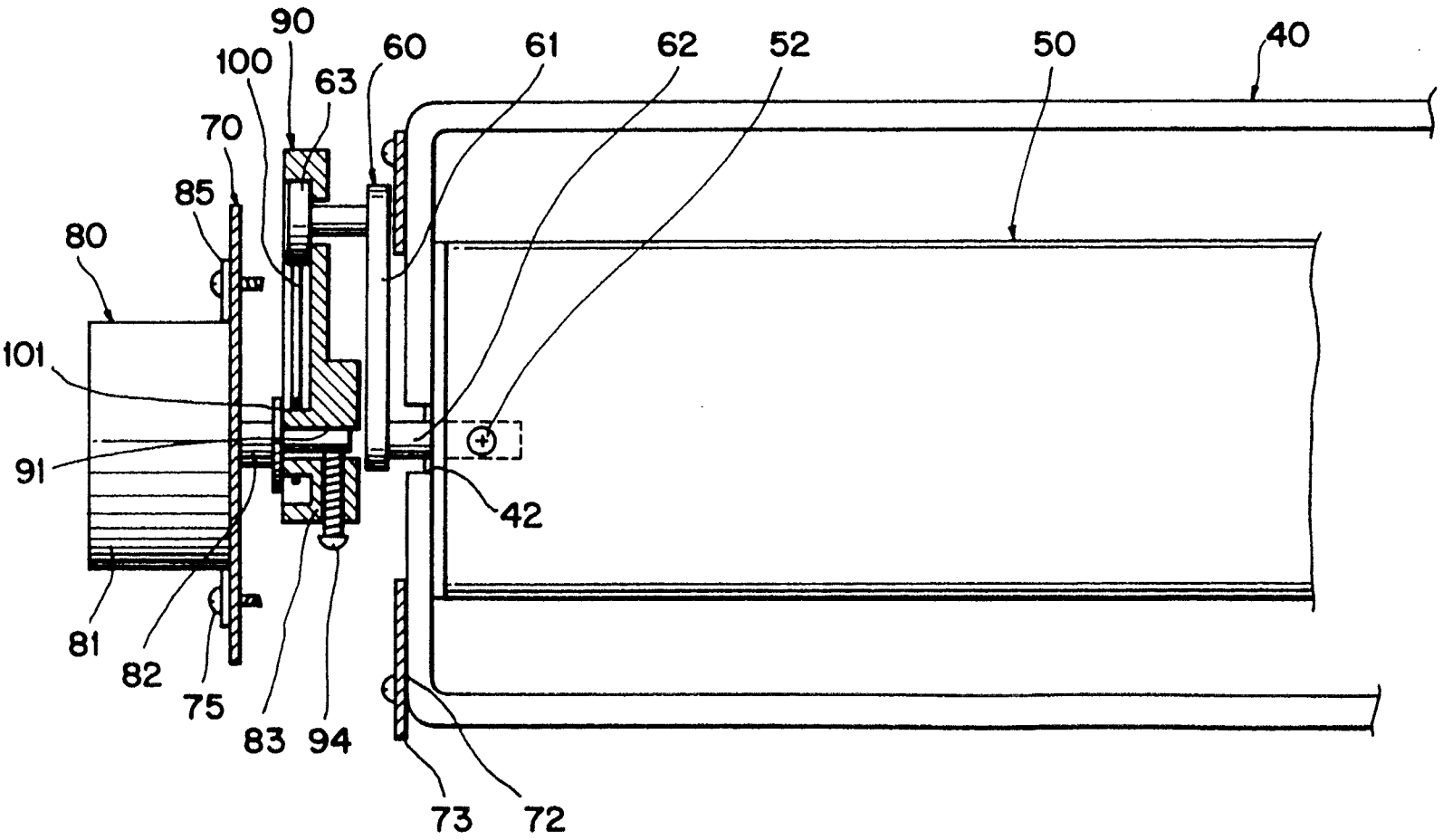
FIG. 2 is a sectional view taken along the line II—II of FIG. 1.
Figure 3:
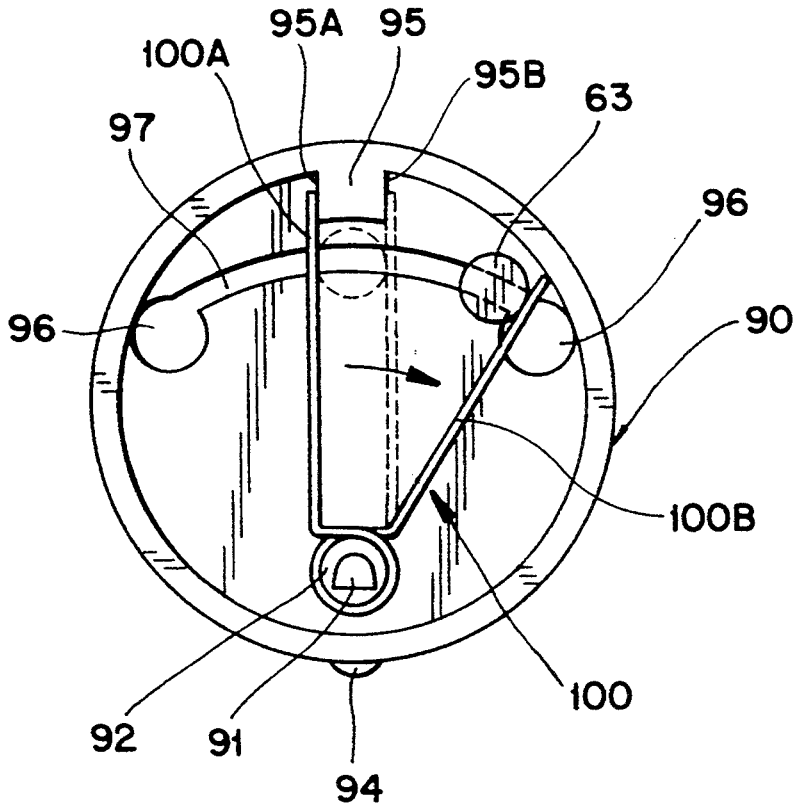
FIG. 3 is a front view of a driving link member when an external force is applied to a louver blade.
Figure 4:
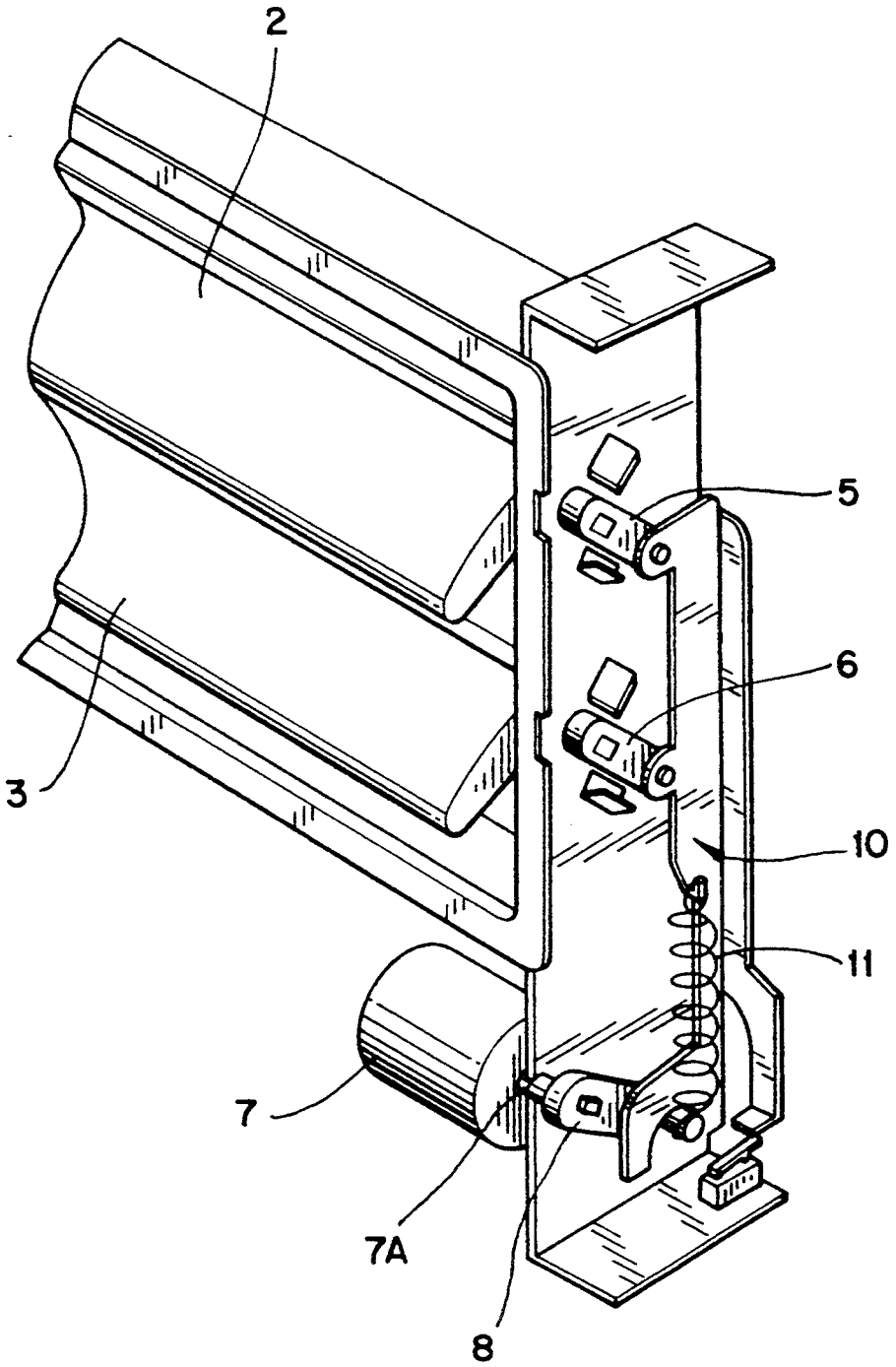
FIG. 4 (PRIOR ART)
FIG. 4 is a perspective view of an air vent control apparatus according to the prior art.
Figure 5:
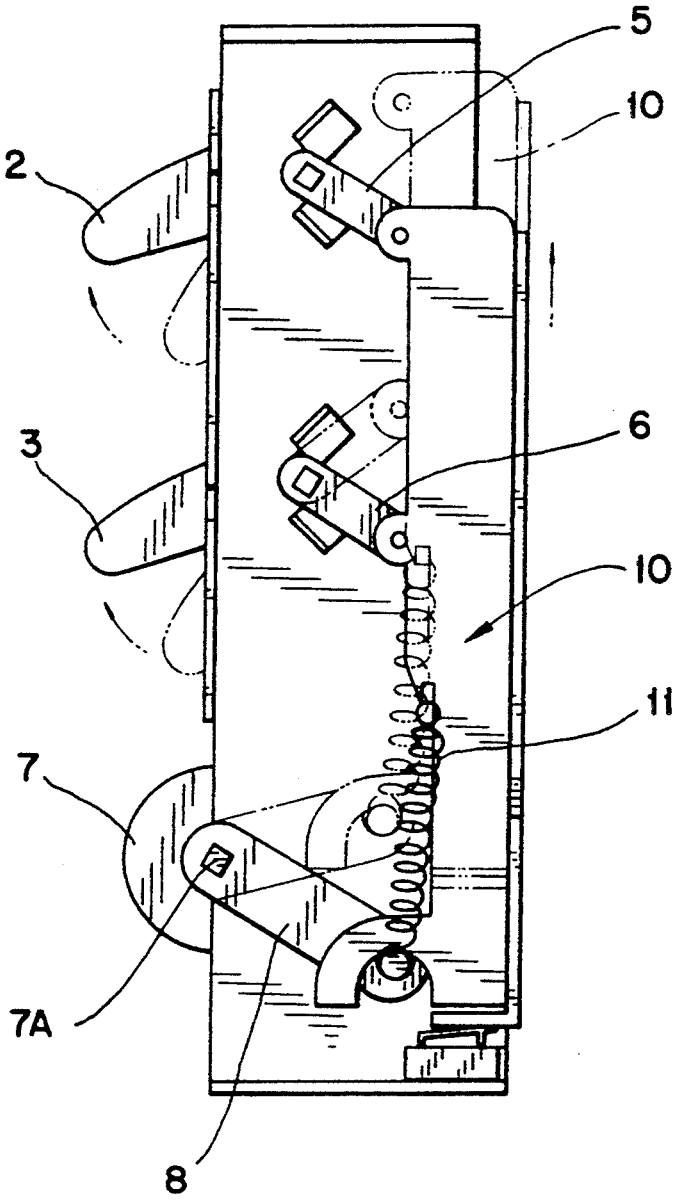
FIG. 5 (PRIOR ART)
FIG. 5 is a side view of the air vent control apparatus depicted in FIG. 4.
Figure 6:
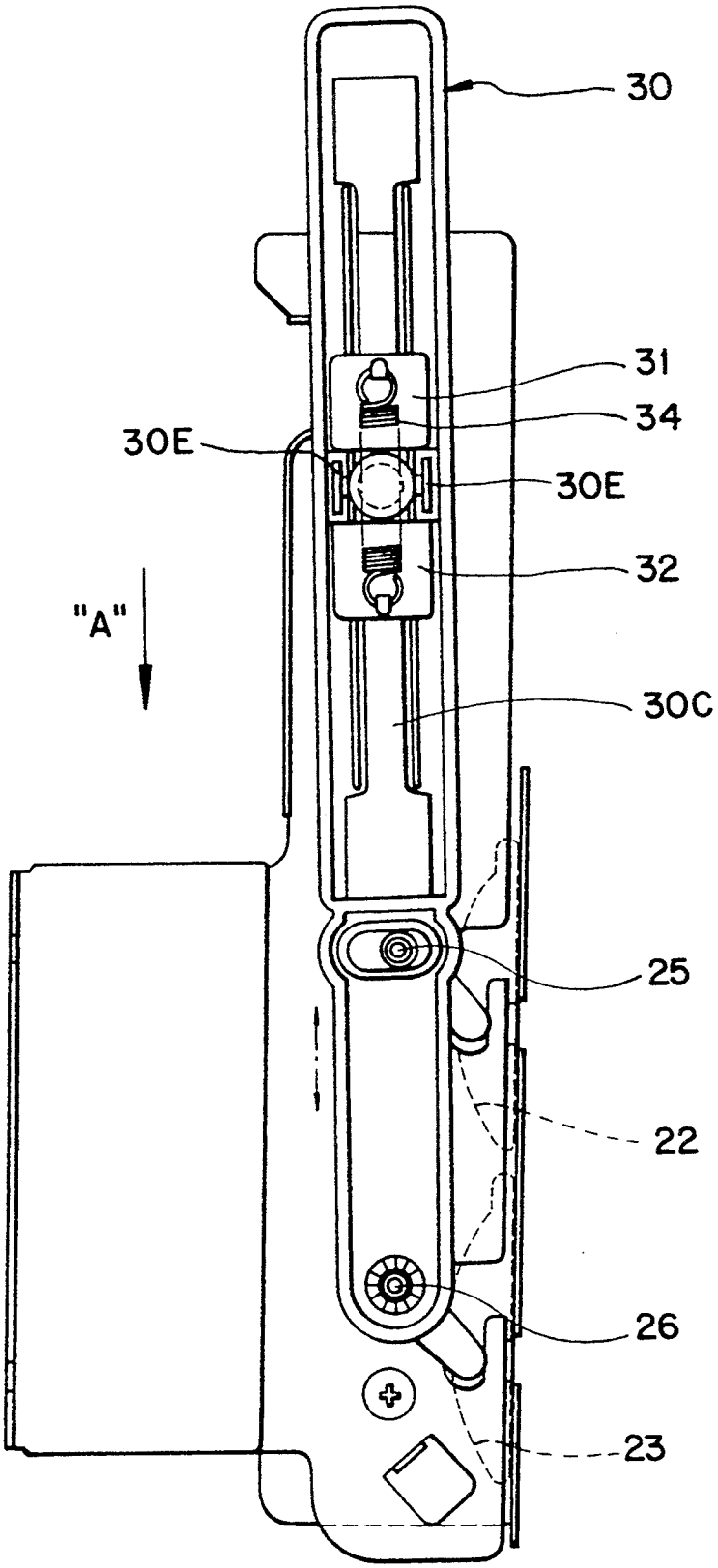
FIG. 6 (PRIOR ART)
FIG. 6 is a perspective view of another air vent control apparatus according to the prior art.
Figure 7:
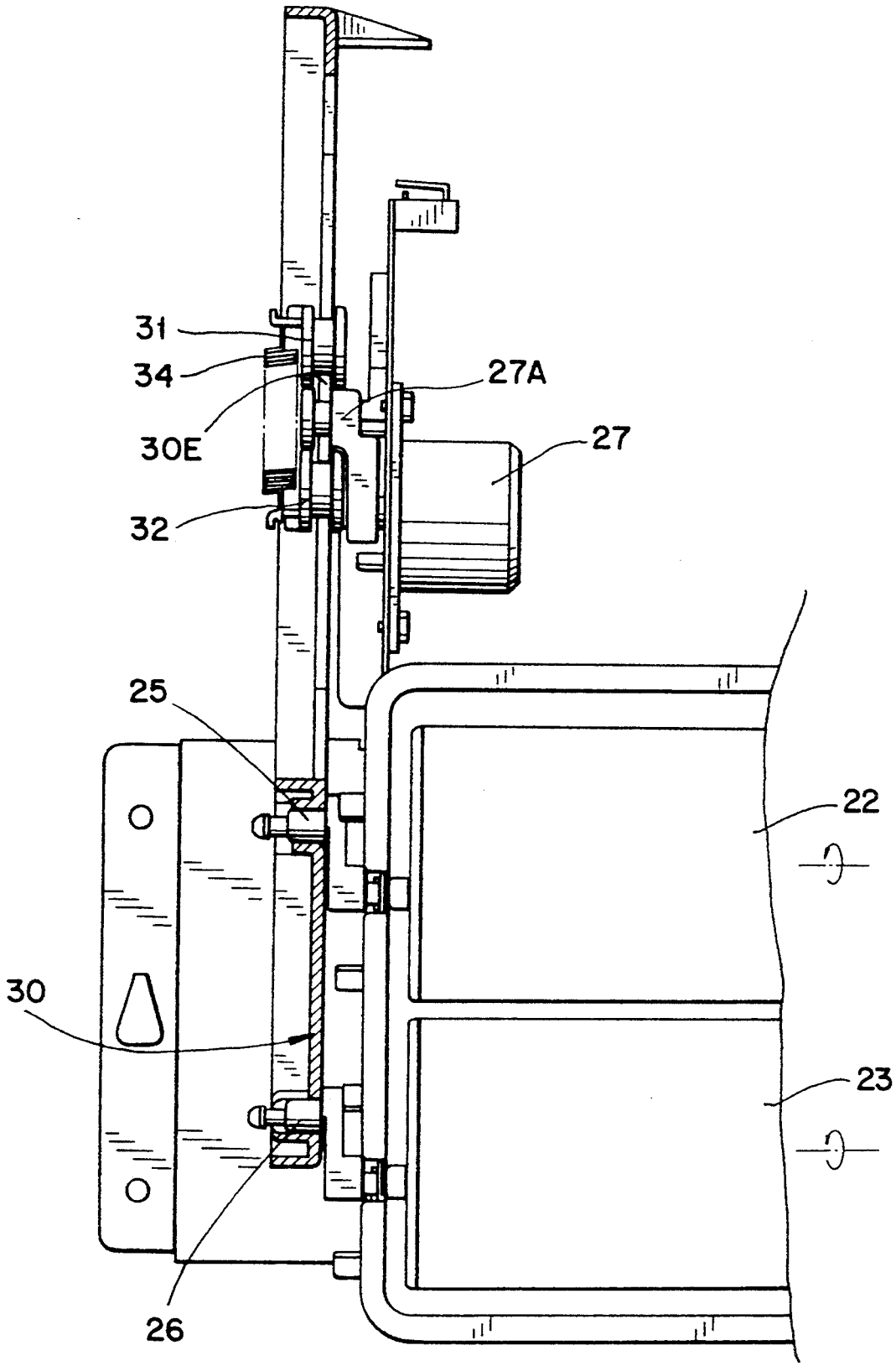
FIG. 7 (PRIOR ART)
FIG. 7 is a front sectional view of no air vent control apparatus depicted in FIG. 6 when an external force is and applied to the louver blade.
Figure 8:
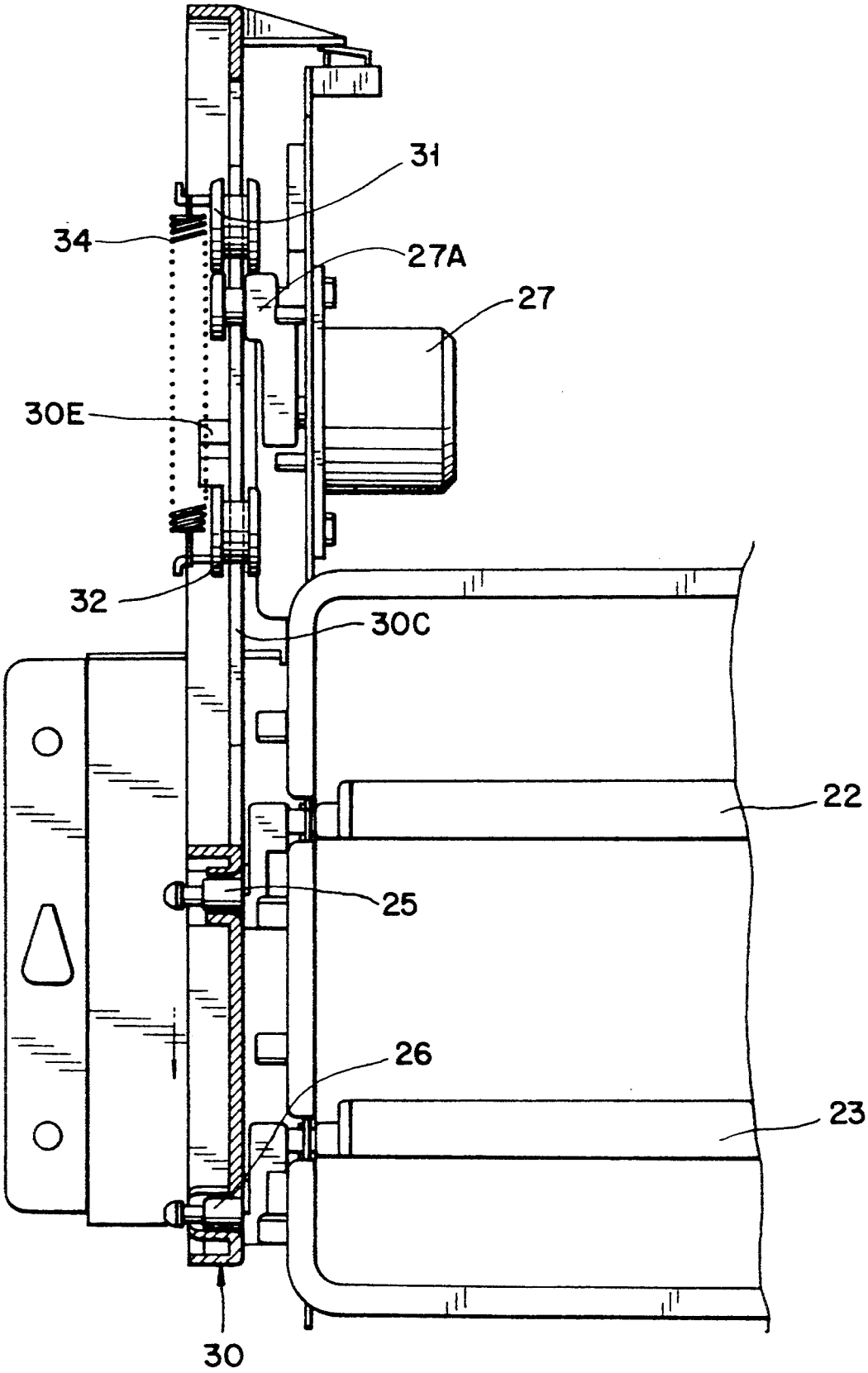
FIG. 8 (PRIOR ART)
FIG. 8 is a front sectional view of an air vent control apparatus depicted in FIG. 6 when the external force is to a louver blade.

FIGS. 1 to 3 illustrate the air vent control apparatus in accordance with one embodiment of the present invention.

The air vent control apparatus comprises an air flow grill member or housing 40 having an air outflow opening 41 and a force generating means 80 which is mounted at one end of the grill member 40 by a bracket 70. The air vent control apparatus further comprises a driving link member 90 which is interconnected with a shaft of the force generating means 80, a driven link member 60 mounted on one surface of the driving link member 90, and an elastic means 100 which is connected witch the driven link member 60 and to the driving link member 90 and absorbs any external force to prevent the transmission of the external back to a motor so and returns the driven link member 60 to the prescribed condition when the external force is released. The air vent control apparatus further comprises a louver blade 50 which is transversely disposed in the outflow opening 41 of the grill member 40.

The air flow grill member 40 comprises the air outflow opening 41 which is formed at the center thereof, a recess 42 which is formed at one side thereof and in which a bar 62 which extends from the driven link member 60 is rotatably mounted, and first thread holes 43 which are formed adjacent to each side of the recess 42 for attaching the bracket 70 onto the side surface of the grill member 40 by first screws 71.

The bracket 70 has connecting plates 73 which are formed at both ends of one side of the bracket 70, for attaching the grill member 40 by first screws 71 and third thread holes 72 at the center thereof, respectively. A recess 74 is formed at the center of another side of the bracket 70 for connecting the force generating means 80 to the driving link member 90. Bent plates 77 are formed at both ends of another side of the bracket 70, and fourth thread holes 76 are formed in the bending plates 77 for fastening the force generating means 80 by third screws 75.

The force generating means 80 comprises a stepping motor 81, and first and second shafts 82 and 83 which rotate the driving link member 90 by the rotational force of the motor 81. The stepping motor 81 includes support plates 85, each of which has a thru-hole 84, for fastening the bracket 70 by a third screw 75. The first shaft 82 and the second shaft 83 are coaxial. The diameter of the first shaft 82 is greater than that of the second shaft 83. A flat surface 86 is formed in a part of the circumference of the second shaft 83.

The driving link member 90 comprises a protrusion 92 which is provided at one side surface of member 90 and has a fastening hole 91 therethrough. Further, at the rim of the driving link member 90 a fifth thread hole 93 is provided for securing the second shaft 83 against rotation relative to the member 90 by a fourth screw 94. At the rim of the driving link member 90 opposite to the fastening hole 91 a stop lug 95 is attached in order to separate both free ends 100A and 100B of the elastic means 100 from each other.

The driven link member 60 comprises a bar 62 which is perpendicularly extended from one end of a connector 61, the bar fitting into an insert hole 51 of the louver blade 50. The driven link member 60 further comprises a neck 63 which perpendicularly extends from the other end of the connector 61 in the opposite direction from the bar 62, a center-line of the neck 63 paralleling that of the bar 62 at a designated distance.

The driving link member 90 further comprises thru-holes 96 which are formed at a given distance from each of the side edges of the stop lug 95, and an arc slot 97 which interconnects both thru-holes 96 the thru-holes 96 permit the neck 63 to be inserted into the slot 97 during assembly of the apparatus.

The elastic means 100 has a torsional coil spring, the center of which has a ring shape which is engaged around the circumference of the protrusion 91. Both free ends 100A and 100B of the spring are placed at respective sides of the neck 63, and are supported by the side edges of the stop lug 95.

The louver blade 50 comprises the insert hole 51 which is axially provided with a proper depth at the center of one side surface of the blade 50 to be fitted with the bar 62. A second thread hole 53 oriented perpendicular to the insert hole 51 at the front surface of the blade 50, receives a second screw 52 for fastening the bar 62 in the insert hole 51.

Numeral 101 references a washer for preventing the spring-up of the elastic means 100.

The air vent control apparatus built as described above is operated as follows. In accordance with the difference between the desired temperature and the indoor temperature, a signal is inputted into the control unit (not shown). Thereafter the stepping motor 81 is activated by the signal outputted from the control unit, whereby the driving link member 90 is rotated in a clockwise or counterclockwise direction (FIG. 3). Simultaneously, the driving link member 90 pushes the driven link member 60, which is supported by the elastic member 100, whereby the link member 60 rotates about the common axis of shaft 83 and bar 62 in a clockwise or counterclockwise direction. The driven link member 60 rotates the louver blade 50 which is connected with the bar 62 of the driven link member 60. The louver blade 50 can be controlled at various angles so as to control the air flow direction which flows out from the opening 41 of the air flow grill member 40.

When an external force is applied against the normal rotation direction of the louver 50, the louver blade 50 simultaneously rotates the driven link member 60. That is, when an external force is applied to the lower portion, i.e. the right hand portion shown in FIG. 1, of the louver blade 50, the free end 100A of the elastic member 100 is supported against one stop surface 95A of the stop lug 95, whereas the other free end 100B of the elastic member 100 is pushed by the neck 63 of the driven link member 60 in a clockwise direction along the arc slot 97 of the driving link member 90 as shown in FIG. 3. That other free end 100B of the elastic member 100 absorbs the rotation force of the driven link member 60 which is generated by the external force, and the driving link member 90 is isolated from the rotation of the driven link member 60 so that the external force cannot be transmitted to the motor 81. Thereafter, when the external force is no longer applied to the other free end 100B of the elastic member 100 or the lower portion of the louver 50, the neck 63 is moved toward the stop plug 95 by the elastic energy of the elastic member 100. Therefore, the louver blade 50 is returned to the prescribed angular relationship to the motor 81.

Alternatively, the effect of absorbing the external force and the return of the position of the blade can be achieved, even when the external force is applied to the upper portion, i.e. the left hand portion shown in FIG. 1, of the louver blade 50. The free end 100B of the elastic member 100 is supported by the stop surface 95B of the stop lug 95, whereas the free end 100A of the elastic member 100 is pushed by the neck 63 of the driven link member 60 in a counterclockwise direction along the arc slot 97 of the driving link member 90. The free end 100A of the elastic member 100 absorbs the rotation force of the driven link member 60 which is generated by the external force. Next, when the external force is no longer applied to the free end 100A of the elastic member 100 or the upper portion of the louver 50 the neck 63 is moved toward the supporter 95 by the elastic energy of the elastic member 100. Therefore, the louver blade 50 is returned to the prescribed angular relationship to the motor 81.

What is claimed is:

1. An air vent mechanism comprising:

a housing;

a louver blade mounted to said housing for movement relative thereto;

a power generator;

a driving link connected to said power generator to be rotated thereby;

a driven link mounted for rotation and connected to said louver blade; and an elastic member interconnecting said driving link and said driven link to rotate said driven link in the same direction as said driving link, said elastic member being elastically yieldable to permit relative rotation between said driving link and said driven link in response to the application of an external force to said louver blade.

2. The air vent mechanism according to claim 1, wherein said driving link and said driven link are mounted for rotation about a common axis of rotation.

3. The air vent mechanism according to claim 1, wherein said driven link comprises a crank arm.

4. The air vent mechanism according to claim 3, wherein one end of said crank arm is mounted in a slot in said driving link.

5. The air vent mechanism according to claim 4, wherein said driving link and said driven link are mounted for rotation about a common axis of rotation.

6. The air vent mechanism according to claim 5, wherein said elastic member comprises a torsional coil spring, a coil portion of which being coaxial with said axis of rotation.

7. The air vent mechanism according to claim 1, wherein said elastic member comprises a torsional coil spring.

8. An air vent mechanism comprising:

a louver blade movable in opposing first and second directions; and a drive mechanism for moving said louver blade, comprising:

a motor having a rotary output shaft;

a driving link operably connected to said output shaft to be rotated thereby about an axis, said driving link including an arcuate slot and first and second stop surfaces;

a driven link having a first end disposed in said slot, and a second end mounted for rotation, permitting said driven link to rotate in clockwise and counterclockwise directions about said axis, said second end being operably connected to said louver blade for moving said louver blade in said first and second directions in response to rotation of said driven link in said clockwise and counterclockwise directions, respectively; and a spring member mounted on said driving link and having first and second ends arranged to apply a spring force to opposite sides of said first end of said driven link for rotating said driven link in one of said clockwise and counterclockwise directions in response to rotation of said driving link, said driving link and said first end of said driven link being relatively movable in either of said directions in response to the application of an external force to said louver blade, whereupon one of said ends of said spring yields elastically to permit such relative movement, while the other end of said spring is supported by a respective one of said stop surfaces.

9. The air vent mechanism according to claim 8, wherein said spring comprises a torsional coil spring having a coil portion arranged coaxial with said axis, said first and second ends of said spring bearing against said opposite sides of said first end of said driven link.

10. The air vent mechanism according to claim 8, wherein said louver blade is rotatable about said axis.

11. The air vent mechanism according to claim 8, wherein said output shaft rotates about said axis.

12. The air vent mechanism according to claim 11 further including a housing in which said louver blade is disposed, said second end of said driven link being rotatably mounted in a side of said housing; a bracket mounted to said side; said motor being mounted on said side.

13. An air vent mechanism comprising:

a housing;

a louver blade mounted in said housing for rotation about an axis;

a driven link in the form of a crank arm having first and second ends, said second end being mounted for rotation and connected to said louver blade;

a drive link mounted for rotation about said axis;

a motor connected to said drive link for rotating said drive link about said axis; and a spring arranged to transmit rotary motion from said drive link to said driven link for adjusting said louver blade, said spring arranged to engage said first end of said driven link at a location spaced radially from said axis;

said drive link and said first end of said driven link being movable relative to one another by elastically deforming said spring in response to the application of an external force to said louver blade.

* * * * *